US005959395A

United States Patent [19]

Sakurai et al.

[11] Patent Number: 5,959,395

[45] Date of Patent: Sep. 28, 1999

[54] CATHODE FOR ELECTRON TUBE

[75] Inventors: Hiroshi Sakurai; Yoshiki Hayashida; Masayuki Kubo, all of Osaka; Katsuyuki Yamashita, Kyoto, all of Japan

[73] Assignee: Matsushita Electronics Corporation, Osaka, Japan

[21] Appl. No.: 08/727,619

[22] PCT Filed: Feb. 29, 1996

[86] PCT No.: PCT/JP96/00493

§ 371 Date: Oct. 18, 1996

§ 102(e) Date: Oct. 18, 1996

[87] PCT Pub. No.: WO97/32330

PCT Pub. Date: Sep. 4, 1997

[51] Int. Cl.[6] ..... H01J 1/14; H01J 19/06; H01J 1/20; H01K 1/04

[52] U.S. Cl. ..... 313/346 R; 313/409; 313/411; 313/337

[58] Field of Search ..... 313/346 R, 346 DC, 313/309, 336–37, 351, 495, 310, 270, 409–411

[56] References Cited

FOREIGN PATENT DOCUMENTS 47-16994 6/1972 Japan .
3-280322 12/1991 Japan .

*Primary Examiner*—Nimeshkumar D. Patel
*Assistant Examiner*—Mack Haynes
*Attorney, Agent, or Firm*—Merchant & Gould P.C.

[57] ABSTRACT

A cathode for an electron tube formed by coating the base of the cathode for the electron tube with an alkaline-earth metal carbonate containing at least barium as the alkaline-earth metal, and thermally decomposing in a vacuum to generate an emitter mainly comprising an alkaline-earth metal oxide, wherein a mixture of two or more kinds of alkaline-earth metal carbonate crystalline particles having different shapes is used as the above mentioned alkaline-earth metal carbonate. Since the present invention can provide a cathode for electron tube having improved both cut-off drift and emission characteristic at the same time, it is useful as a cathode for the electron gun of a CRT, or a cathode for the electron gun of an electron microscope.

2 Claims, 9 Drawing Sheets

CATHODE FOR ELECTRON TUBE

TECHNICAL FIELD

This invention relates to cathodes for electron tubes used for a cathode ray tube (CRT), etc., and relates in particular to improvement of the emitter thereof.

BACKGROUND ART

Conventionally, cathodes for electron tubes, which comprise a base mainly comprising nickel and including a reducing element such as silicon and magnesium coated with alkaline-earth metal carbonate crystalline particles and thermally decomposed in a vacuum to generate an emitter mainly comprising an alkaline-earth metal oxide, have been used broadly.

Scanning electron microscope images illustrating the shapes of representative alkaline-earth metal carbonate crystalline particles used for an emitter of cathodes conventionally used for electron tubes are shown in FIG. 8–FIG. 10. Various shapes of the alkaline-earth metal carbonate crystalline particles are known such as spherical represented by FIG. 8, dendritic represented by FIG. 9, and bar-like represented by FIG. 10. In coating these on the cathode base, an aggregate of crystalline particles having the same shape, namely, only spherical particles or only dendritic particles (JP-A-3-280322) has been used. The "same shape" herein denotes the shape of crystalline particles obtained under the same synthetic conditions, and thus strictly speaking, individual crystalline particles may have slight variations in size or shape, but the shape of one kind by a geometric classification is suggested.

When the above mentioned emitter mainly comprising an alkaline-earth metal oxide produced by coating the cathode base with an alkaline-earth metal carbonate and thermally decomposing in a vacuum is used as a cathode for a CRT, since the emitter is maintained at a temperature around 700° C. in a usual CRT operation state, a problem occurs in that the entire emitter gradually has thermal shrinkage as time passes. The thermal shrinkage triggers the gradual drift of the cut-off voltage to cut off the emission (hereinafter called cut-off drift). The amount of the cut-off drift (hereinafter called cut-off drift amount) varies depending upon the shape of the crystalline particles of the above mentioned alkaline-earth metal carbonate; and the cut-off drift amount is smaller in the dendritic than in the bar-like, and smaller in the spherical than in the dendritic. However, on the other hand, the emission characteristic varies depending upon the above mentioned shape; and the emission characteristic is better in the dendritic than in the spherical, and better in the bar-like than in the dendritic.

An example of the emitter mainly comprising an alkaline-earth metal oxide generated by using a cathode base mainly comprising nickel and including 0.1 weight % of magnesium and 0.05 weight % of aluminum with respect to the base weight as the reducing elements, and using an alkaline-earth metal carbonate containing barium and strontium in the composition ratio (molar ratio) of 1:1 as the above mentioned alkaline-earth metal component, and further adding 3 weight % of scandium oxide as the rare earth metal oxide into the alkaline-earth metal carbonate so as to improve the emission characteristic, coating the above mentioned base with the composition at a thickness of approximately 50 $\mu$m, and thermally decomposing in a vacuum (a high vacuum of $10^{-6}$ Torr or less herein) at about 930° C. is shown in FIG. 11 regarding the state of the cut-off drift with respect to the operation time, and shown in FIG. 12 regarding the saturation current remaining ratio, an indicator of the emission characteristics when used as the cathode of a CRT. The saturation current remaining ratio is the normalized value of the saturation current with respect to the operation time based on the initial value of the saturation current as 1 (the ratio of the saturation current with respect to the operation time in the case of setting the initial value of the saturation current as 1), and it can be said that the larger the saturation current remaining ratio, the better the emission characteristic. The operation conditions in FIG. 11 and FIG. 12 are that the voltage of the heater to heat the cathode is operated at a 10% increased rate with respect to the ordinary use condition to accelerate the change with the passage of time, the so-called examination results under the accelerated conditions.

"a", "b", "c" in FIG. 11 and FIG. 12 denote the results when the alkaline-earth metal carbonate crystalline particles of the spherical form having an average diameter of 0.7 $\mu$m, the dendritic form having an average length of 5 $\mu$m, and the bar-like form having an average length of 7 $\mu$m illustrated in FIG. 8, FIG. 9, FIG. 10 respectively are used as the material. The length of the dendritic crystals is the length between the edge of the trunk to the farthest edge of the branch on the opposite side.

From these FIGS., the tendency that one having a comparatively small cut-off drift amount does not have good emission characteristic and one having comparatively good emission characteristic has a large cut-off drift amount can be read. Thus it can be learned that by merely selecting the above mentioned shape of the crystalline particles the improvement of both the cut-off drift and the emission characteristic at the same time is difficult.

The object of the present invention is to solve the problem in the above mentioned conventional example to provide a cathode for electron tube improved both in the cut-off drift and in the emission characteristic of the cathode for electron tube.

DISCLOSURE OF INVENTION

In order to achieve the above mentioned object, the present invention relates to a cathode for an electron tube formed by coating the base of the cathode for the electron tube with an alkaline-earth metal carbonate containing at least barium as the alkaline-earth metal, and thermally decomposed in a vacuum to generate an emitter mainly comprising an alkaline-earth metal oxide, wherein a mixture of two or more kinds of alkaline-earth metal carbonate crystalline particles having different shapes is used as the above mentioned alkaline-earth metal carbonate.

In the production of the above mentioned cathode for electron tube, by using a mixture of two or more kinds of alkaline-earth metal carbonate crystalline particles having different shapes, it can be considered that the entire emitter becomes unlikely to collapse, thereby restraining the amount of the thermal shrinkage of the emitter, since the difference of the shapes allows one type of crystalline particles to enter the gap among the other crystalline particles. Thus, a cathode improved with respect to both the cut-off drift and the emission characteristic at the same time can be provided compared with the case of using alkaline-earth metal carbonate crystalline particles of one kind of shape.

In the cathode for an electron tube of the present invention, by having a preferable embodiment of the present invention wherein the alkaline-earth metal carbonate is a mixture of two kinds of alkaline-earth metal carbonate crystalline particles of the spherical form and the dendritic form having branches, by preventing the collapse of the entire emitter by the virtue of the spherical crystalline particles entering the gap among the dentritic crystalline particles, the amount of the thermal shrinkage of the emitter is restrained. Thus it can be considered that a cathode for an electron tube improved with respect to both the cut-off drift and the emission characteristic at the same time can be provided.

Moreover, in the cathode for electron tube of the present invention, by having a preferable embodiment of the present invention wherein the alkaline-earth metal carbonate is a mixture of two kinds of alkaline-earth metal carbonate crystalline particles of the spherical form and the bar-like form, by preventing the collapse of the entire emitter by the virtue of the spherical crystalline particles entering the gap among the bar-like crystalline particles, the amount of the thermal shrinkage of the emitter is restrained. Thus, it can be considered that a cathode for an electron tube improved with respect to both the cut-off drift and the emission characteristic at the same time can be provided.

Furthermore, in the cathode for electron tube of the present invention, by having a preferable embodiment of the present invention wherein the alkaline-earth metal carbonate is a mixture of three kinds of alkaline-earth metal carbonate crystalline particles of the spherical, the dentritic and the bar-like forms, by further preventing the collapse of the entire emitter by the virtue of the above mentioned crystalline particles of the three kinds of shapes being present and these crystalline particles being mixed to have a further reduced gap among the crystalline particles, the amount of the thermal shrinkage of the emitter is further restrained. Thus, it can be considered that a cathode for an electron tube further improved with respect to both the cut-off drift and the emission characteristic at the same time can be provided.

BEST MODE FOR CARRYING OUT THE INVENTION

Figure 1:
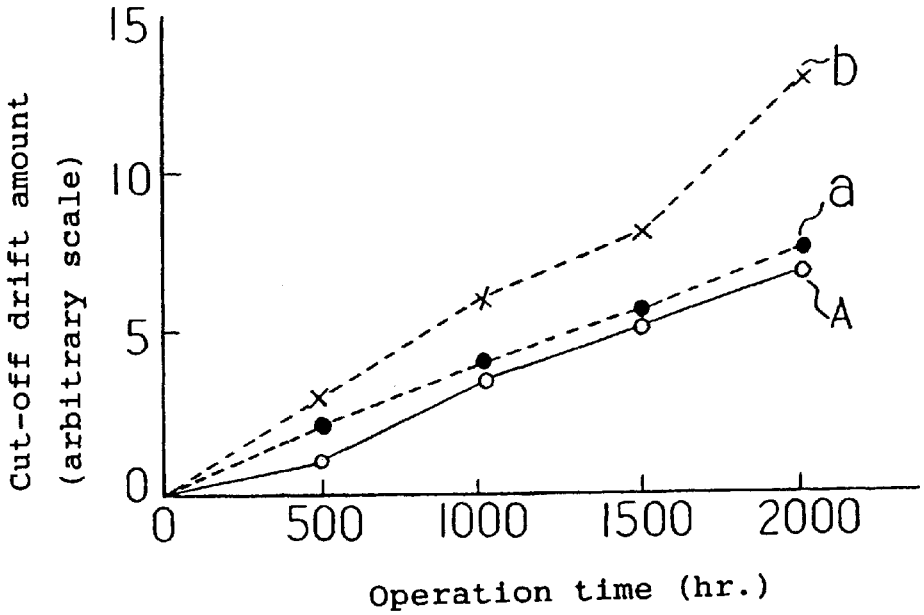
FIG. 1 is a graph illustrating the relationship between the operation time and the cut-off drift amount of the CRT in the first example of the present invention.

A cathode for an electron tube of the present invention comprises a base for the cathode for the electron tube, coated with an alkaline-earth metal carbonate containing at least barium as the alkaline-earth metal, and thermally decomposed in a vacuum to generate an emitter mainly comprising an alkaline-earth metal oxide, wherein a mixture of two or more kinds of alkaline-earth metal carbonate crystalline particles having different shapes is used as the alkaline-earth metal carbonate.

The alkaline-earth metal carbonates containing barium used in the present invention are not particularly limited, but alkaline-earth metal carbonates containing 40 mol % or more of barium as the alkaline-earth metal component are preferably used. Alkaline-earth metal carbonates containing other alkaline-earth metal components such as strontium and calcium together with barium as an alkaline-earth metal component can be used preferably as well. In particular, alkaline-earth metal carbonates containing barium and strontium are preferably used, for example, binary carbonates such as barium-strontium carbonate or ternary carbonates such as barium-strontium-calcium carbonate are preferably used. In this case, although it is not particularly limited, alkaline-earth metal carbonates containing 40 mol % or more of barium and 30 mol % or more of strontium as a component of alkaline-earth metal are preferable.

In the present invention, as the above mentioned alkaline-earth metal carbonates, a mixture of two or more kinds of alkaline-earth metal carbonate crystalline particles having different shapes is used. "Different shapes" denotes shapes classified geometrically in different groups from a macroscopicpoint of view. For example, taking the spherical crystalline particles for instance, even when the variety in size or shape of the crystalline particles exists, if the crystalline particles are nearly spherical, they are not described as different shapes. In general, alkaline-earth metal carbonate crystalline particles obtained under the same synthetic conditions have the same shape, and thus in order to obtain a mixture of alkaline-earth metal carbonate crystalline particles having two or more kinds of different shapes, alkaline-earth metal carbonate crystalline particles having different shapes obtained from two or more kinds of different synthetic conditions respectively are mixed and used.

It is not particularly limited but, for example, spherical alkaline-earth metal carbonate crystalline particles can be obtained by adding an aqueous solution of sodium carbonate as the precipitant to an aqueous solution of an alkaline-earth metal nitrate to precipitate the crystals of the alkaline-earth metal carbonate and drying after filtration. In order to obtain bar-like alkaline-earth metal carbonate crystalline particles, ammonium hydrogencarbonate can be used as the precipitant in place of sodium carbonate in the above mentioned synthetic method. In order to obtain dendritic alkaline-earth metal carbonate crystalline particles, ammonium carbonate can be used as the precipitant in place of sodium carbonate in the above mentioned synthesis method.

The mixing of alkaline-earth metal carbonate crystalline particles having different shapes can be carried out by, for example, mechanically mixing crystalline particles having two or more kinds of different shapes with an agitator. Further, it is preferable to add a rare metal oxide such as europium oxide, yttrium oxide, dysprosium oxide, scandium oxide, lanthanum oxide, and gadolinium oxide in the range of 20 weight % or less to the alkaline-earth metal carbonate, since it can further improve the emission characteristic of the cathode of the present invention.

The mixing ratio of the alkaline-earth metal carbonate crystalline particles having two or more kinds of different shapes is not particularly limited, and if even a little amount of crystalline particles of another shape is mixed, it contributes to the improvement of the cut-off drift and the emission characteristic compared with the case of crystalline particles having the shape of only one kind, but favorably it is preferable to contain crystalline particles of each shape at the ratio of about 0.2 or more based on the entire weight ratio respectively.

As a base of a cathode for electron tube, a base usually used can be used, and thus it is not particularly limited. In general, a base mainly comprising nickel and containing a reducing element such as silicon and magnesium is used, and as the reducing element, although it is not particularly limited, at least one kind from silicon, magnesium, aluminum, thalium, etc. is used. The amount of the reducing element is not particularly limited, but it is in general, about 0.05 to 0.8 weight % in total based on the weight of the base.

To coat the base of the cathode for the electron tube with the above mentioned mixture of alkaline-earth metal carbonate crystalline particles, for example, a method of dispersing the above mentioned mixture of alkaline earth metal carbonate crystalline particles in an organic medium, which does not dissolve the alkaline-earth metal carbonate crystalline particles and preferably has a comparatively low boiling point, to form a dispersion, and spraying the dispersion to the base of a cathode with a spray gun and drying is generally used, but it is not limited to this method. As the organic media for the dispersion, ethyl nitrate, ethyl acetate, diethyl oxalate can be illustrated as typical examples, but it is not limited thereto, and other organic media can be used as long as they have a comparatively low boiling point and do not dissolve a carbonate nor react with a carbonate.

The thickness of the above mentioned mixture of alkaline-earth metal carbonate crystalline particles coated on the base of the cathode for electron tube cannot be prescribed sweepingly since it varies depending upon the kind of the electron tube, etc., but for example, it is about 30–80 $\mu$m.

The above mentioned alkaline-earth metal carbonate crystalline particles coated as heretofore described to the base of the cathode for electron tube are thermally decomposed in a vacuum to form an alkaline-earth metal oxide. Although it depends on the kind of the contained alkaline-earth metal, in general, they are thermally decomposed in a high vacuum of $10^{-6}$ Torr or less at a high temperature of 900° C. or more. However, it is not limited to this condition and other conditions may be adopted as long as an oxide can be generated without the risk of including much impurities in the air.

EXAMPLE 1

Figure 13:
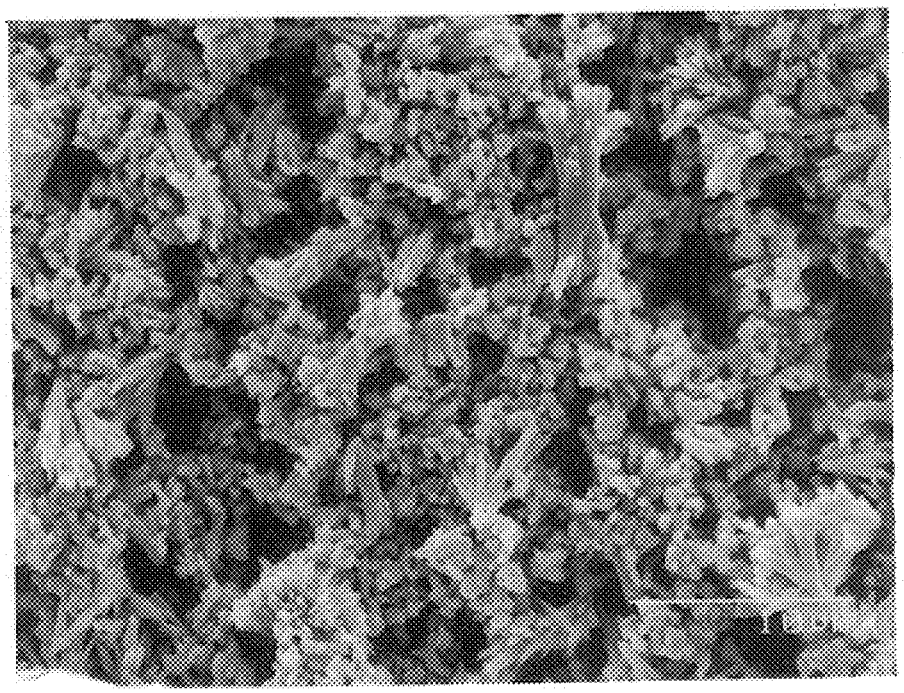
FIG. 13 is a scanning electron microscope image of a mixture of spherical and dendritic crystalline particles in accordance with Example 1.

As the first example of the present invention, the alkaline-earth metal carbonate containing barium and strontium with the composition ratio (molar ratio) of 1:1 as the alkaline-earth metal, and comprising the spherical crystalline particles having an average diameter of 0.7 $\mu$m shown in FIG. 8 and the dendritic crystalline particles having an average longer axis of 5 $\mu$m shown in FIG. 9 mixed at the weight ratio of 1:1 will be explained. A 3000X scanning electron microscope image of the mixture of spherical and dendritic particles is seen in FIG. 13.

The above mentioned spherical alkaline-earth metal carbonate crystalline particles were obtained by dissolving barium nitrate and strontium nitrate at the molecular ratio of 1:1 in water, adding an aqueous solution of sodium carbonate as the precipitant to precipitate the crystals of barium-strontium carbonate, filtering and then drying. The above mentioned dendritic alkaline-earth metal carbonate crystalline particles were obtained using the same conditions as mentioned above except that an aqueous solution of ammonium carbonate was used as the precipitant in place of an aqueous solution of sodium carbonate. 3 weight % of scandium oxide was further added to the obtained spherical and dendritic alkaline-earth metal carbonate crystalline particles to form a mixture. This mixture was dispersed in ethyl nitrate, and the dispersion was coated on the cathode base with a spray gun by a thickness of approximately 50 $\mu$m, and thermally decomposed in a vacuum of $10^{-6}$ Torr or less at 930° C. to generate an emitter mainly comprising alkaline-earth metal oxide. As the cathode base here, nickel containing 0.1 weight % of magnesium and 0.05 weight % of aluminum based on the base weight as the reducing element was used.

Figure 2:
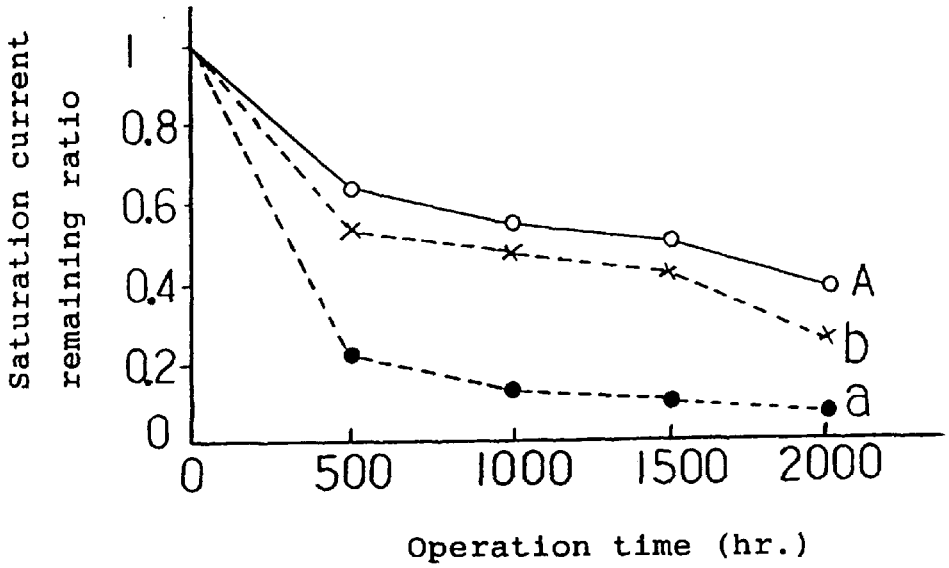
FIG. 2 is a graph illustrating the relationship between the operation time and the saturation current remaining ratio of the CRT in the first example of the present invention.

The state of the cut-off drift with respect to the operation time when the obtained cathode was used as the cathode of the CRT is shown in FIG. 1, and the saturation current remaining ratio, which is one of the indicators of the emission characteristics, is shown in FIG. 2. In both FIGS., concerning the operation conditions of the CRT, experiment was conducted under so-called accelerated conditions by accelerating a change with the passage of time in the cathode characteristics by adjusting the voltage of the heater to heat the cathode at an increased rate by 10% with respect to an ordinary usage condition.

Figure 11:
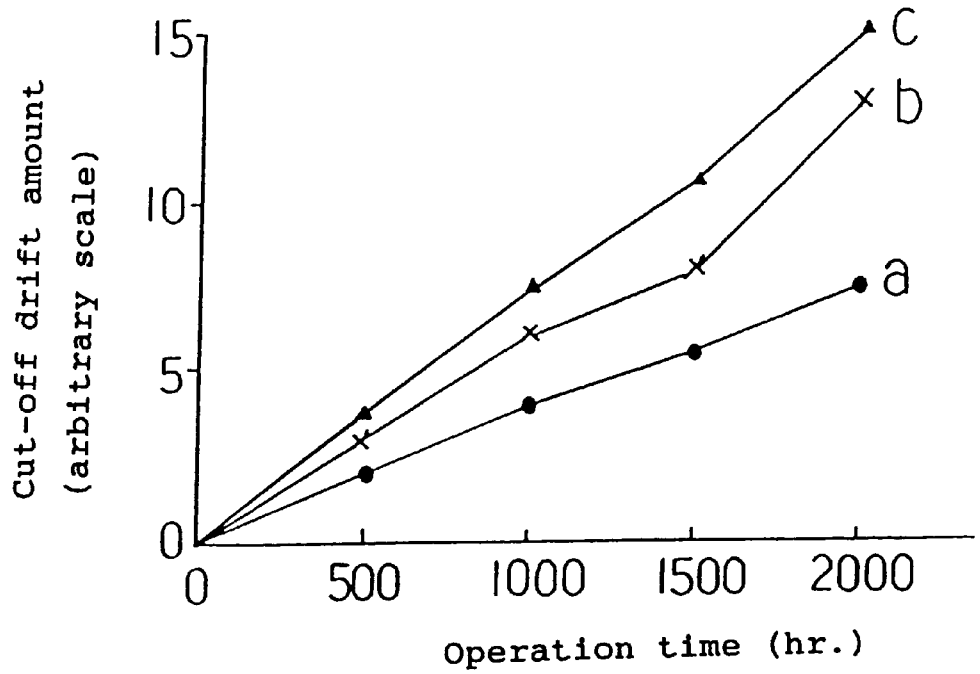
FIG. 11 is a graph illustrating the relationship between the operation time and the cut-off drift amount of the CRT when conventional alkaline-earth metal carbonate crystalline particles of respective shapes are used.
Figure 12:
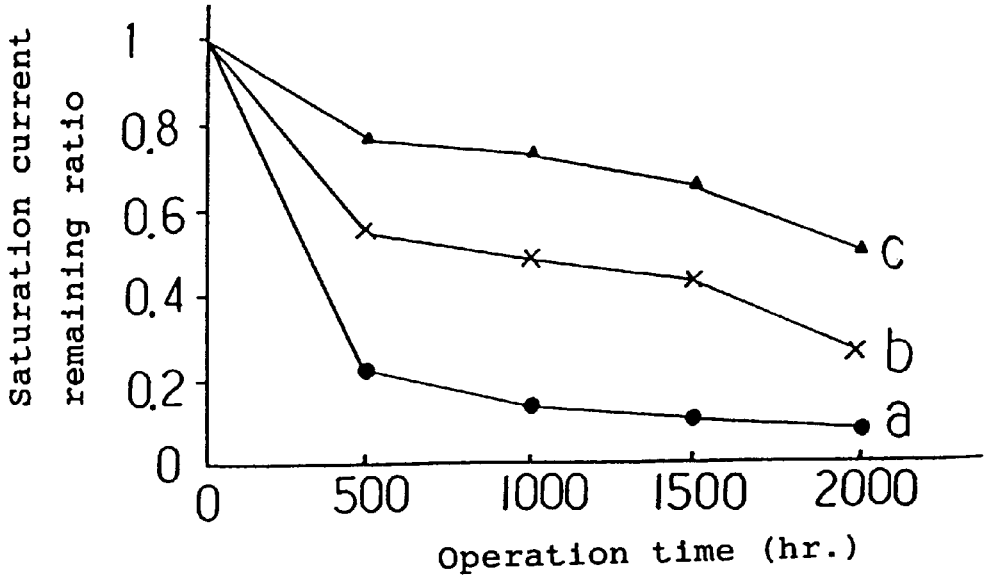
FIG. 12 is a graph illustrating the relationship between the operation time and the saturation current remaining ratio of the CRT when conventional alkaline-earth metal carbonate crystalline particles of respective shapes are used.

Solid lines "A" in FIG. 1 and FIG. 2 denote this example, and dotted lines "a", "b" are conventional examples shown in FIG. 11 and FIG. 12 partially described for comparison. "a" is the case where only the spherical crystalline particles having an average diameter of 0.7 $\mu$m shown in FIG. 8 were used, and "b" is the case where only the dendritic crystalline particles having an average longer axis of 5 $\mu$m shown in FIG. 9 were used as the alkaline-earth metal carbonate.

By referring to FIG. 1, it can be observed that the cut-off drift amount of "A", which is a mixture of the spherical crystalline particles and the dendritic crystalline particles of this example, is smaller than the cut-off drift amount of "b", which includes only the dendritic crystalline particles of the conventional technology, and shows the value equivalent or slightly smaller than the cut-off drift amount of "a", which includes only the spherical crystalline particles. That is, it can be said that the characteristics concerning the cut-off drift of "A" are equivalent or superior to the others, "a" and "b".

On the other hand, by referring to FIG. 2, it can be observed that the saturation current remaining ratio of "A", which is the case when the spherical crystalline particles and dendritic crystalline particles were mixed and used according to this embodiment, is larger than the saturation current remaining ratio of "a", which includes only the spherical form of the conventional technology, and slightly larger than the saturation current remaining ratio of "b", which includes only the dendritic form. That is, it can be said that the emission characteristic of "A" is superior to others, "a", "b". Accordingly, it can be learned that both the cut-off drift and the emission characteristic can be improved at the same time by this invention illustrated in this example.

Figure 3:
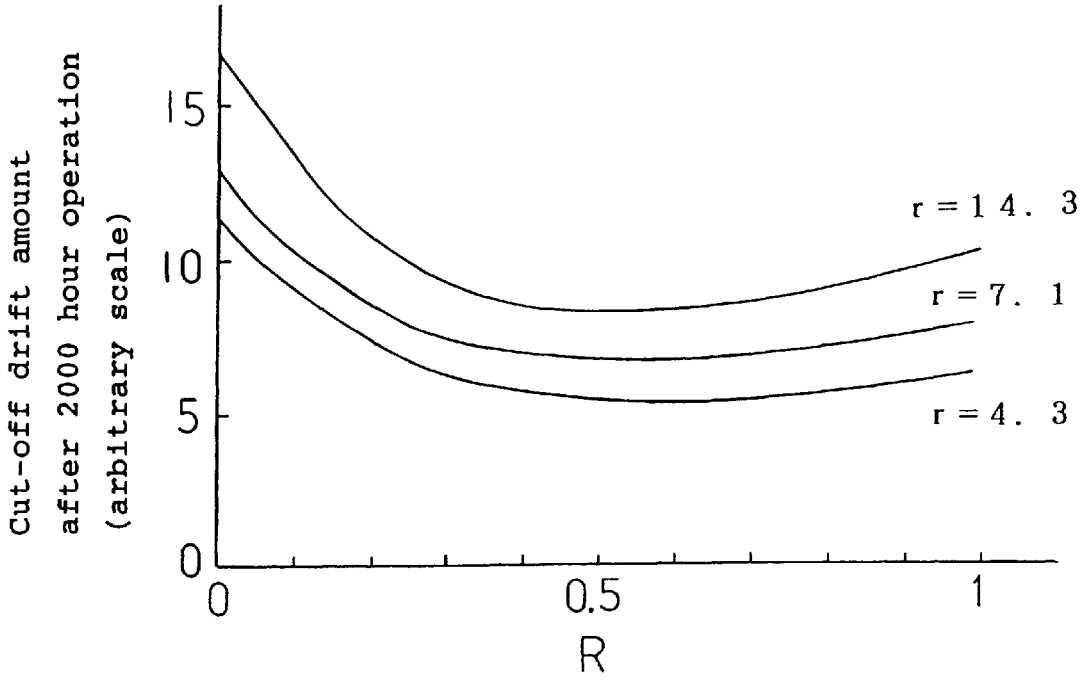
FIG. 3 is a graph illustrating the relationship between the mixing ratio of the spherical and dendritic crystalline particles of the alkaline-earth metal carbonate and the cut-off drift amount in the first example of the present invention.

Although the average diameter of the spherical crystalline particles was 0.7 μm and the average length of the dendritic crystalline particles was 5 μm, and the mixing ratio of the spherical crystalline particles and the dendritic crystalline particles was 1:1 by weight ratio in the above mentioned first example, these values are representative and thus other various combinations of values can be used, and the experiment results are shown in FIG. 3 collectively.

The horizontal axis of FIG. 3 illustrates the weight ratio "R" of the spherical crystalline particles with respect to the dendritic crystalline particles, and the vertical axis illustrates the cut-off drift amount after 2000 hours of operation under the acceleration conditions. And the ratio of the average length of the dendritic crystalline particles with respect to the average diameter of the spherical crystalline particles is shown by "r", and curves in FIG. 3 denote r=14.3, r=7.1, r=4.3 in descending order. According to this FIG., when "R" is at around 0.5 (the mixing ratio 1:1 of the spherical crystalline particles and the dendritic crystalline particles) a tendency of the cut-off drift amount becoming minimum is observed, and the tendency is stronger as the "r" becomes larger. The reason thereof can be considered that the amount of the thermal shrinkage of the emitter is restrained by the spherical crystalline particles entering the gap among the dendritic crystalline particles so as to prevent the collapse of the entire emitter. Anyway, with respect to the case when the dendritic crystalline particles are used, the cut-off drift tends to be improved by mixing even a small amount of spherical crystalline particles. Further, when "R" is in the range of 0.2–0.8, improvement of the cut-off drift is particularly good. At this time, as to the emission characteristic, a characteristic similar to the characteristic of the crystalline particles having a higher saturation current remaining ratio always appears regardless of the mixing ratio, but the mechanism thereof has not been made clear yet.

EXAMPLE 2

Figure 14:
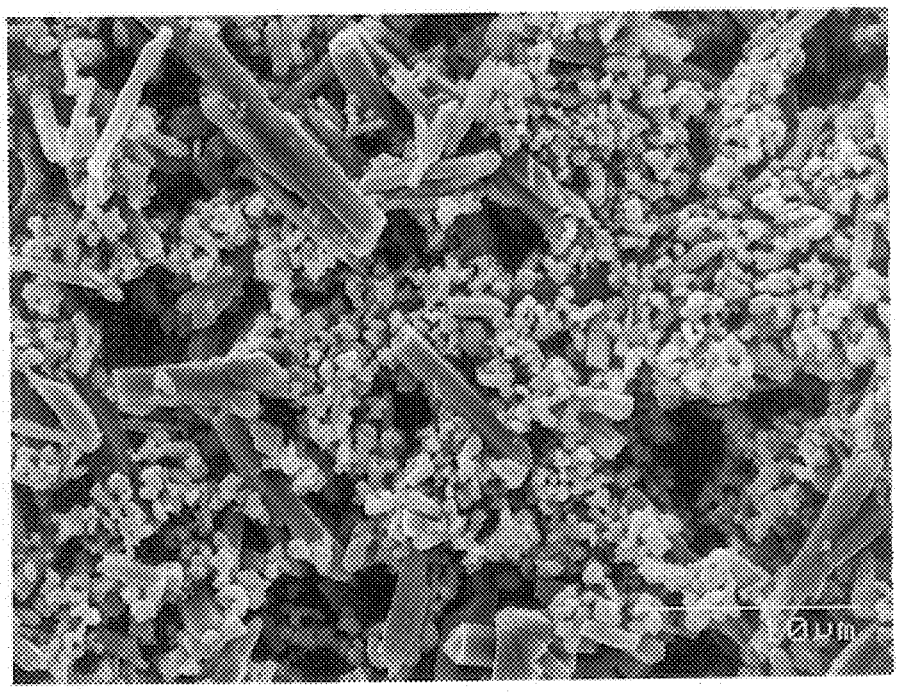
FIG. 14 is a scanning electron microscope image of a mixture of spherical and bar-like crystalline particles as disclosed in Example 2.

As the second example of the present invention, the alkaline-earth metal carbonate containing barium and strontium with the composition ratio (molar ratio) of 1:1 as the alkaline-earth metal, and comprising the spherical crytalline particles having an average diameter of 0.7 μm shown in FIG. 8 and the bar-like crystalline particles having an average length of 7 μm shown in FIG. 10 mixed at the weight ratio of 1:1 will be explained. A 3000X scanning electron microscope image of the mixture spherical and bar-like crystalline particles is seen in FIG. 14.

The bar-like alkaline-earth metal carbonate crystalline particles were obtained by dissolving barium nitrate and strontium nitrate at the molecular ratio of 1:1 in water, adding an aqueous solution of ammonium hydrogen carbonate as the precipitant to precipitate the crystals of barium-strontium carbonate, filtering and then drying.

Figure 4:
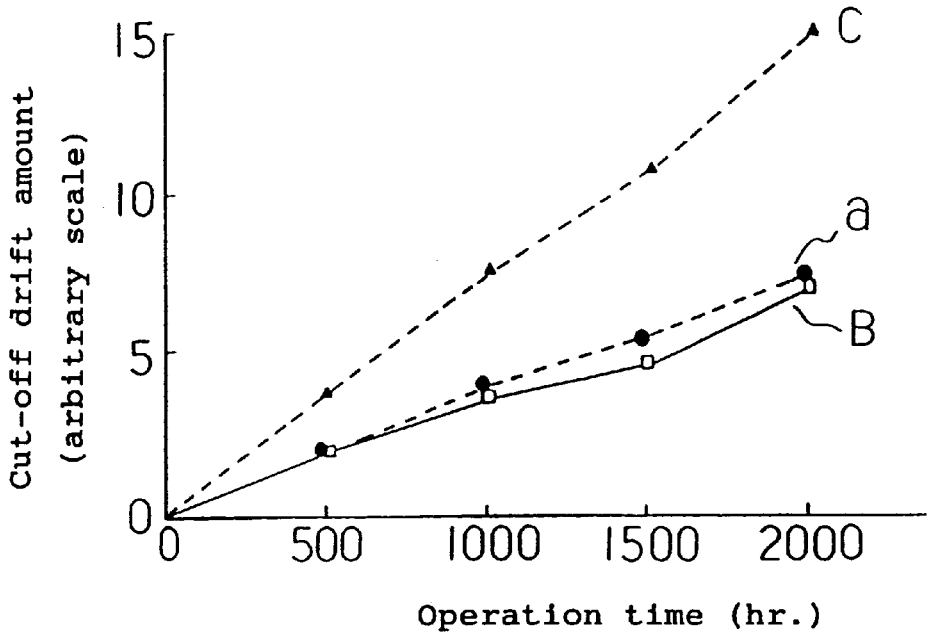
FIG. 4 is a graph illustrating the relationship between the operation time and the cut-off drift amount of the CRT in the second example of the present invention.
Figure 5:
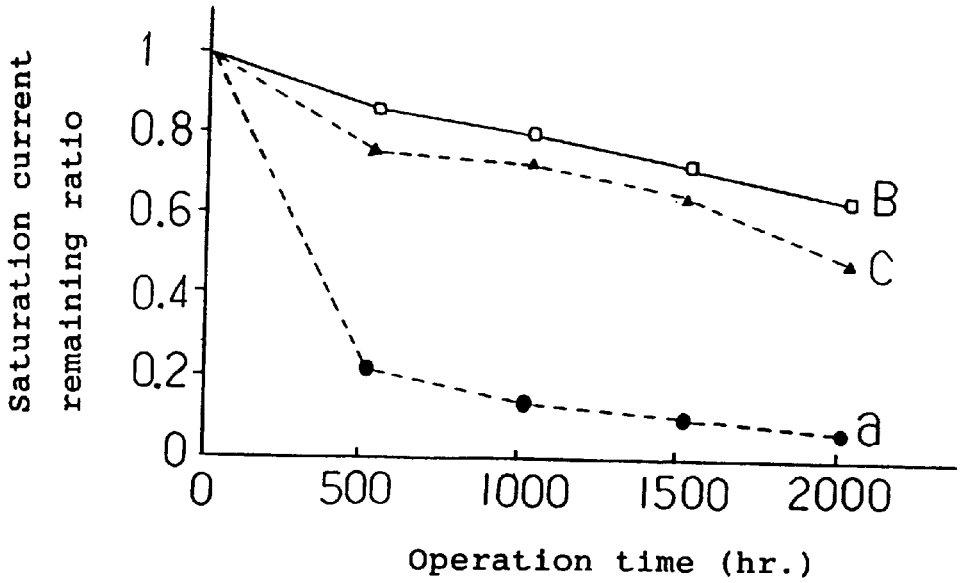
FIG. 5 is a graph illustrating the relationship between the operation time and the saturation current remaining ratio of the CRT in the second example of the present invention.

The other conditions are the same as the first example, and hereinafter in the same process, 3 weight % of scandium oxide was included in the mixture of the alkaline-earth metal carbonate crystalline particles, coated on the cathode base, and thermally decomposed in a vacuum to generate an emitter mainly comprising alkaline-earth metal oxide. The state of the cut-off drift with respect to the operation time when it was used as the cathode of the CRT is shown in FIG. 4, and the saturation current remaining ratio is shown in FIG. 5. As in the first example, the operation conditions of the CRT were the accelerated conditions.

Solid lines "B" in FIG. 4 and FIG. 5 denote this example, and dotted lines "a", "c" are conventional examples shown in FIG. 11 and FIG. 12 partially described for comparison. "a" is the case where only the spherical crystalline particles having an average diameter of 0.7 μm shown in FIG. 8 were used, and "c" is the case where only the bar-like crystalline particles having an average length of 7 μm shown in FIG. 10 were used as the alkaline-earth metal carbonate.

By referring to FIG. 4, it can be observed that the cut-off drift amount of "B", which is the case of this example when the spherical crystalline particles and the bar-like crystalline particles were mixed and used is smaller than the cut-off drift amount of "c", which includes only the bar-like crystalline particles of the conventional technology, and shows the value equivalent or slightly smaller than the cut-off drift amount of "a", which includes only the spherical crystalline particles. That is, it can be said that the characteristics concerning the cut-off drift of "B" is equivalent or superior to the others, "a" and "c".

On the other hand, by referring to FIG. 5, it can be observed that the saturation current remaining ratio of "B", which is the case when the spherical crystalline particles and bar-like crystalline particles were mixed and used according to this embodiment, is larger than the saturation current remaining ratio of "a", which includes only the spherical crystalline particles of the conventional technology, and slightly larger than the saturation current remaining ratio of "c", which includes only the bar-like crystalline particles. That is, it can be said that the emission characteristic of "B" is superior to the others, "a" and "c". Accordingly, it can be learned that both the cut-off drift and the emission characteristic can be improved at the same time by this invention, as illustrated in this example as well as in the first example.

EXAMPLE 3

Figure 6:
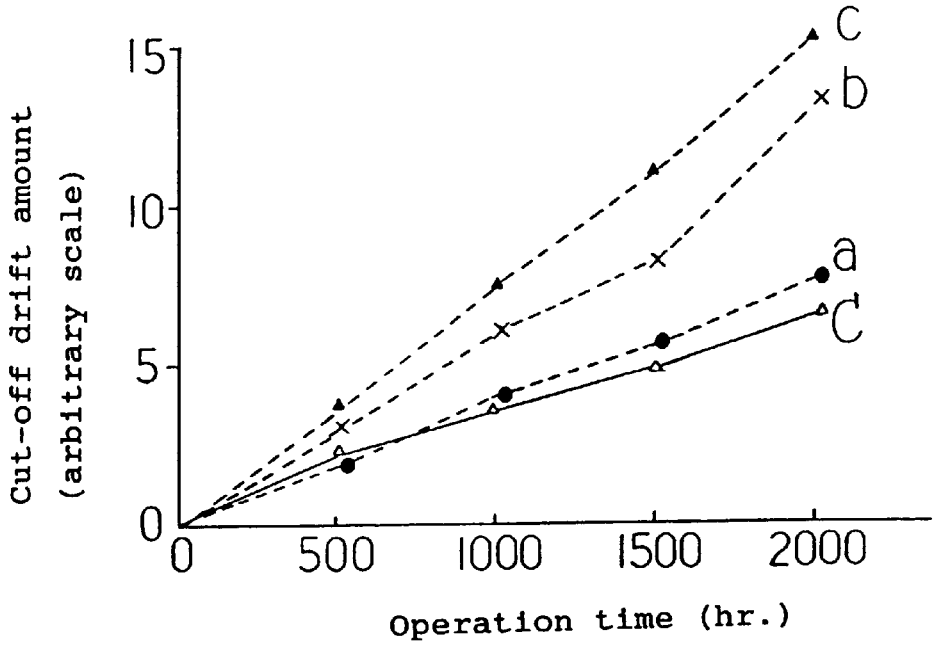
FIG. 6 is a graph illustrating the relationship between the operation time and the cut-off drift amount of the CRT in the third example of the present invention.
Figure 7:
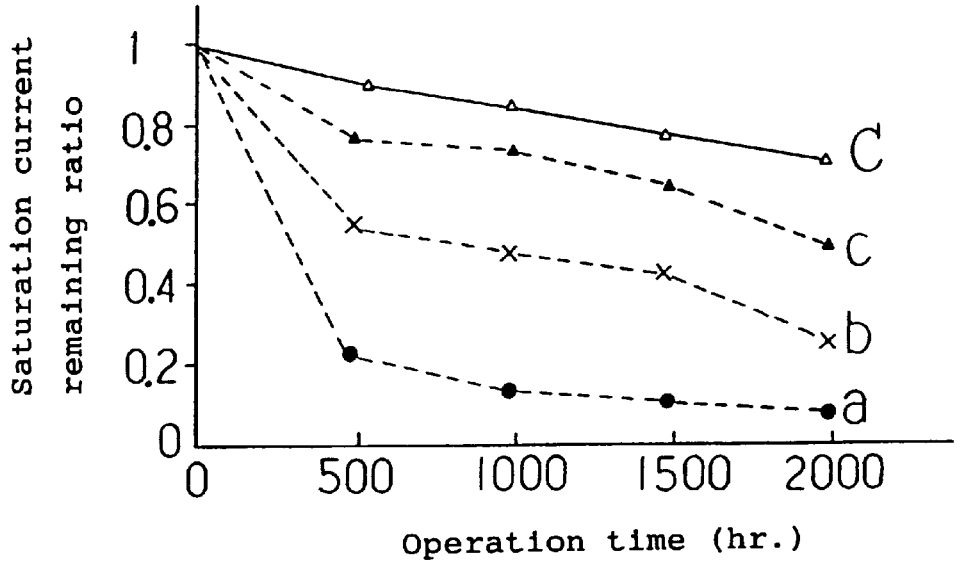
FIG. 7 is a graph illustrating the relationship between the operation time and the saturation current remaining ratio of the CRT in the third example of the present invention.
Figure 8:
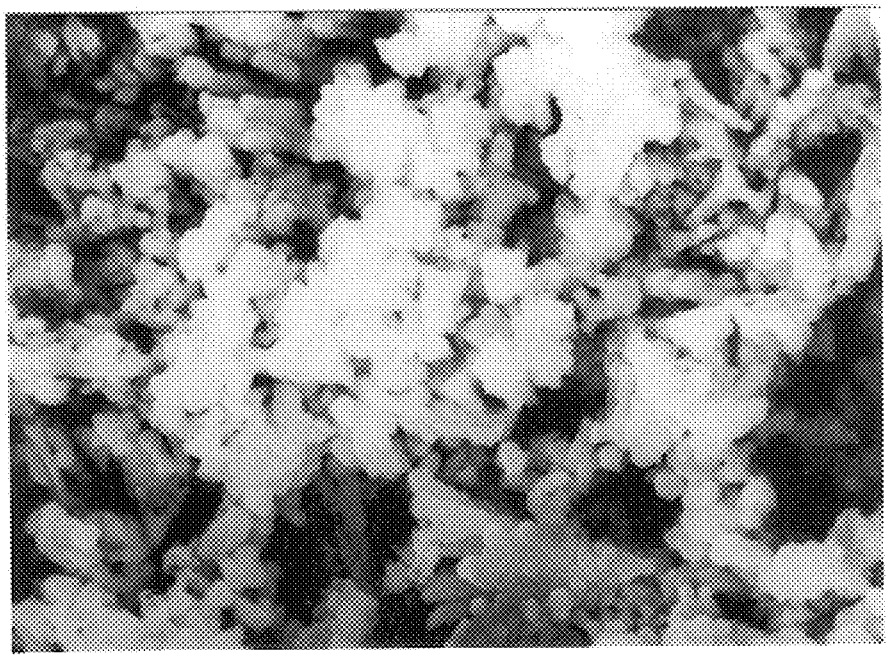
FIG. 8 is a scanning electron microscope image of the spherical crystalline particles of a conventional alkaline-earth metal carbonate.
Figure 9:
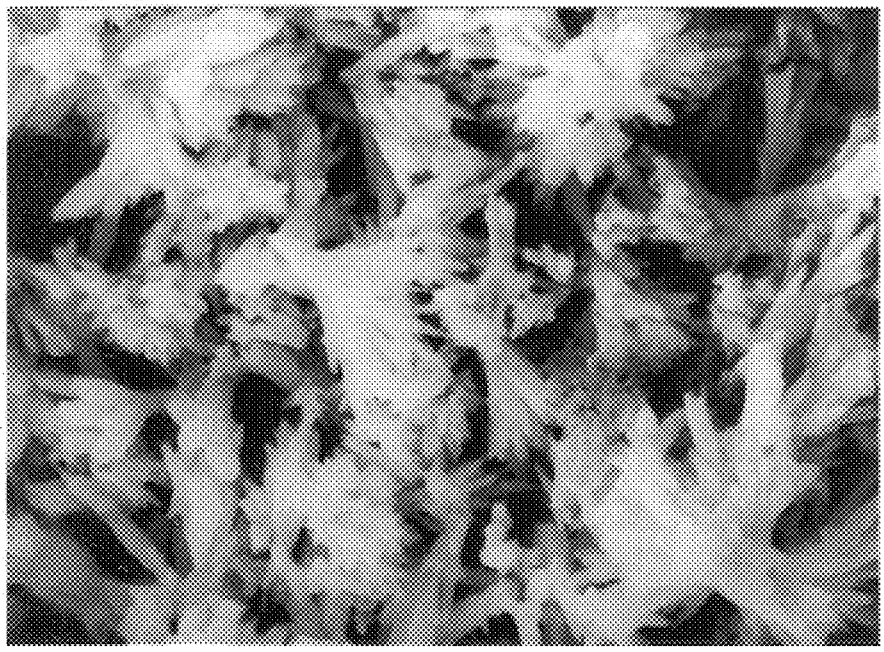
FIG. 9 is a scanning electron microscope image of the dendritic crystalline particles of a conventional alkaline-earth metal carbonate.
Figure 10:
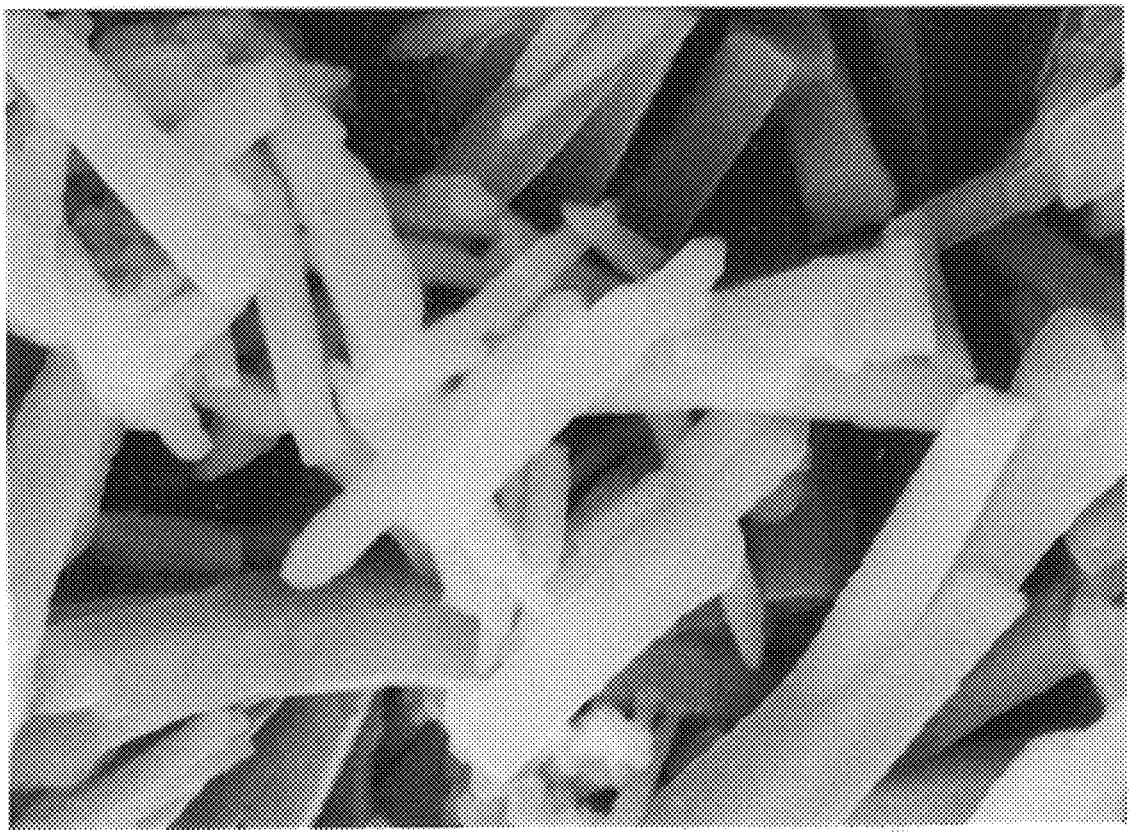
FIG. 10 is a scanning electron microscope image of the bar-like crystalline particles of a conventional alkaline-earth metal carbonate.
Figure 15:
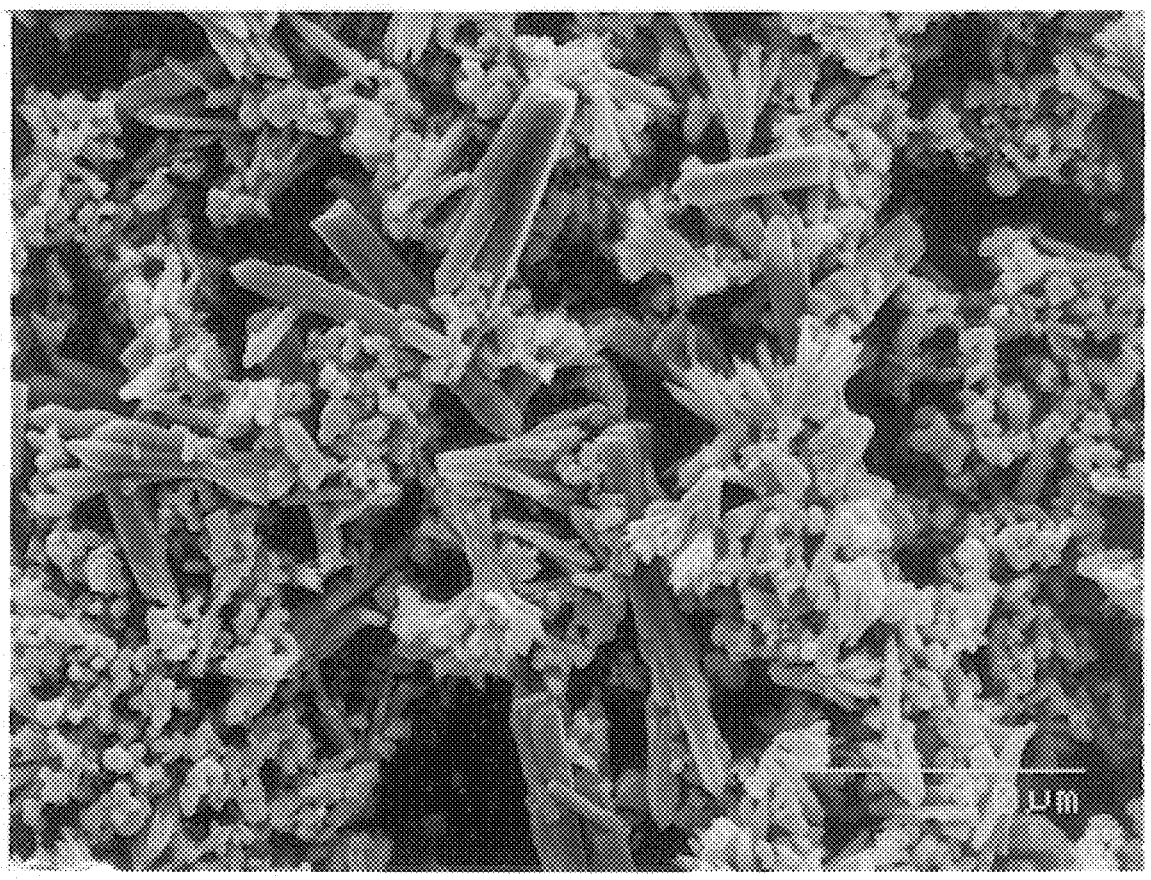
FIG. 15 is a scanning electron microscope image of a mixture of spherical, dendritic, and bar-like crystalline particles in accordance with Example 3.

As the third example of the present invention, the alkaline-earth metal carbonate containing barium and strontium with the composition ratio (molar ratio) of 1:1 as the alkaline-earth metal, and comprising the spherical crytalline particles having an average diameter of 0.7 μm shown in FIG. 8, the dendritic crystalline particles having an average length of 5 μm shown in FIG. 9, and the bar-like crystalline particles having an average length of 7 μm shown in FIG. 10, mixed at the weight ratio of 1:1 will be explained. A 3000X scanning electron microscope image of the mixture of spherical, dendritic, and bar-like crystalline particles is seen in FIG. 15. Alkaline-earth metal carbonate crystalline particles of each shape were synthetized according to the same method as in the preceding examples respectively, and other conditions are the same as in the preceding examples, and hereinafter in the same process, 3 weight % of scandium oxide was included in the mixture of the alkaline-earth metal carbonate crystalline particles, coated on the cathode base, and thermally decomposed in a vacuum to generate an emitter mainly comprising alkaline-earth metal oxide. The state of the cut-off drift with respect to the operation time when it was used as the cathode of the CRT is shown in FIG. 6, and the saturation current remaining ratio is shown in FIG. 7. As in the first and second examples, the operation conditions of the CRT were the accelerated conditions.

Solid lines "C" in FIG. 6 and FIG. 7 denote this example, and dotted lines "a", "b", "c" are conventional examples shown in FIG. 11 and FIG. 12 described for comparison. "a" is the case where only the spherical crystalline particles having an average diameter of 0.7 μm shown in FIG. 8 were used, "b" is the case where only the dendritic crystalline particles having an average length of 5 μm shown in FIG. 9 were used, and "c" is the case where only the bar-like crystalline particles having an average length of 7 μm shown in FIG. 10 were used as the alkaline-earth metal carbonate.

By referring to FIG. 6, it can be observed that the cut-off drift amount of "C", which is the case when the spherical crystalline particles, the dendritic crystalline particles and the bar-like crystalline particles were mixed and used according to this embodiment, is smaller than the cut-off drift amount of "b", which includes only the dendritic crystalline particles, or "c", which includes only the bar-like crystalline particles of the conventional technology, and shows the value equivalent or slightly smaller than the cut-off drift amount of "a", which includes only the spherical crystalline particles of the conventional technology. That is, it can be said that the characteristics concerning the cut-off drift of "C" are equivalent or superior to the others, "a", "b" and "c".

On the other hand, by referring to FIG. 7, it can be observed that the saturation current remaining ratio of "C", which is the case when the spherical, dendritic and bar-like crystalline particles were mixed and used according to this embodiment is larger than the saturation current remaining ratio of "a", which includes only the spherical of the conventional technology, or "b", which includes only the dendritic, and slightly larger than the saturation current remaining ratio of "c", which includes only the bar-like crystalline particles and further larger compared with the saturation current remaining ratios in the first and second examples. That is, it can be said that the emission characteristic of "C" is not only superior to the others, "a", "b", "c", but also superior to the first and second examples stated above. Accordingly, it can be learned that both the cut-off drift and the emission characteristic can be improved at the same time by this invention illustrated in this example with equal or more effectiveness than in the first and second examples. The mixing ratio in mixing the spherical, dendritic and the bar-like crystalline particles is not particularly limited but it is more effective when the crystalline particles of each shape are included in a ratio of 20 weight % or more respectively.

The examples explained above are representative, and concerning the average longer axis and the shape of the crystalline particles, those other than the above mentioned can be applied. Although alkaline-earth metal carbonates including barium and strontium by the composition ratio of 1:1 as the alkaline-earth metal were mentioned, by having the above mentioned composition ratio other than 1:1 or by including calcium in addition to barium and strontium as the above mentioned alkaline-earth metal, the effects of the present invention can be attained. Although 3 weight % of scandium was included in the alkaline-earth metal carbonate in the above mentioned examples, the content ratio can be other than 3 weight %, for example, the content ratio can be 0 weight %, and for example, yttrium oxide or dysprosium oxide can be used in place of scandium oxide.

Industrial Applicability

As heretofore explained, in this invention, by using a mixture of two or more kinds of crystalline particles having different shapes for the alkaline-earth metal carbonate, a cathode for an electron tube having improved both cut-off drift and emission characteristic at the same time can be provided.

Further, in the cathode for electron tube of the present invention, by having a preferable embodiment of the present invention where the alkaline-earth metal carbonate is a mixture of three kinds of the spherical, dendritic and bar-like alkaline-earth metal carbonate crystalline particles, a cathode for electron tube having further improved cut-off drift and emission characteristic at the same time can be provided.

Since the cathodes for electron tube of the present invention have the above mentioned effects, they can be effectively used as the cathode for electron tube which is used as the cathode for the cathode ray tube of a television or other CRTs, or as the electron gun of an electron microscope.

We claim:

1. A cathode for an electron tube formed by coating a base of the cathode for an electron tube with an alkaline-earth metal carbonate containing at least barium as the alkaline-earth metal, and thermally decomposing in a vacuum to generate an emitter mainly comprising an alkaline-earth metal oxide, wherein a mixture of two kinds of alkaline-earth metal carbonate crystalline particles selected from a spherical form and either a dendritic form having branches or a bar-like form is used as the alkaline-earth metal carbonate, and an average particle size of the dendritic or bar-like alkaline-earth metal carbonate crystalline particles is larger than an average particle size of the spherical alkaline-earth metal carbonate crystalline particles.

2. A cathode for an electron tube formed by coating a base of the cathode for an electron tube with an alkaline-earth metal carbonate containing at least barium as the alkaline-earth metal, and thermally decomposing in a vacuum to generate an emitter mainly comprising an alkaline-earth metal oxide, wherein the alkaline-earth metal carbonate is a mixture of three kinds of alkaline-earth metal carbonate crystalline particles of a spherical form and a dendritic form and a bar-like form, and an average particle size of the bar-like alkaline-earth metal carbonate crystalline particles is larger than an average particle size of the dendritic alkaline-earth metal carbonate crystalline particles and an average particle size of the dendritic alkaline-earth metal carbonate crystalline particles is larger than an average particle size of the spherical alkaline-earth metal carbonate crystalline particles.

* * * * *